United States Patent [19]

Kircher

[11] 4,375,400

[45] Mar. 1, 1983

[54] ELECTROLYTE CIRCULATION IN AN ELECTROLYTIC CELL

[75] Inventor: Morton S. Kircher, Clearwater, Fla.

[73] Assignee: Olin Corporation, New Haven, Conn.

[21] Appl. No.: 250,981

[22] Filed: Apr. 3, 1981

Related U.S. Application Data

[63] Continuation-in-part of Ser. No. 213,801, Dec. 8, 1980, Pat. No. 4,339,321.

[51] Int. Cl.[3] ..... C25B 9/00; C25B 15/08

[52] U.S. Cl. ..... 204/237; 204/258; 204/257

[58] Field of Search ..... 204/253–258, 204/237, 263–266

[56] References Cited

U.S. PATENT DOCUMENTS

| | | | |
|---|---|---|---|
| 1,660,147 | 2/1928 | Allan | 204/256 X |
| 2,012,046 | 8/1935 | Jewett | 204/237 X |
| 2,350,669 | 6/1944 | Boller | 204/237 |
| 3,477,938 | 11/1969 | Kircher | 204/266 |
| 3,477,939 | 11/1969 | Kircher | 204/268 |
| 3,755,108 | 8/1973 | Raetzsch et al. | 204/256 X |
| 3,855,091 | 12/1974 | Piester | 204/128 |
| 3,898,149 | 8/1975 | Kircher et al. | 204/252 |
| 3,928,150 | 12/1975 | Rahn et al. | 204/98 |
| 3,928,165 | 12/1975 | Piester | 204/278 |
| 3,945,908 | 3/1976 | Hempell et al. | 204/258 X |
| 4,076,603 | 2/1978 | Andersen | 204/98 |
| 4,138,295 | 2/1979 | DeNora et al. | 204/98 |
| 4,174,266 | 11/1979 | Jeffery | 204/98 |
| 4,212,714 | 7/1980 | Coker et al. | 204/98 |
| 4,217,199 | 8/1980 | Cunningham | 204/256 |
| 4,295,953 | 10/1981 | Fuseya et al. | 204/263 X |

FOREIGN PATENT DOCUMENTS

| | | |
|---|---|---|
| 53-12742 | 2/1978 | Japan . |
| 1523045 | 8/1978 | United Kingdom . |

*Primary Examiner*—Donald R. Valentine

*Attorney, Agent, or Firm*—Ralph D'Alessandro; Donald F. Clements; Thomas P. O'Day

[57] ABSTRACT

In a filter press membrane chloralkali electrolytic cell there is provided an improved external electrolyte recirculation system wherein the salt brine and deionized water replenisher feed lines are inserted individually within the electrolyte return conduits from each external gas-liquid disengager to thereby introduce feed electrolyte into a reservoir of electrolyte fluid which is in low resistance contact with the electrodes.

16 Claims, 3 Drawing Figures

ELECTROLYTE CIRCULATION IN AN ELECTROLYTIC CELL

This application is a continuation-in-part of U.S. patent application Ser. No. 213,801, filed Dec. 8, 1980 now U.S. Pat. No. 4,339,321.

The present invention relates generally to the system utilized to recirculate electrolyte from the external gas-liquid disengagers to the appropriate electrodes within an electrochemical cell. More specifically, the present invention relates to an improved external recirculation system that connects the electrolyte feed, the caustic and brine discharge lines to the appropriate electrolyte return conduit in a manner which promotes thorough mixing of the recycled and replenished fluids and allows for a controlled concentration gradient in the appropriate electrolyte fluid within each electrode, as well as minimizing the leakage of electricity in the electrical circuit to ground and decreasing the possibility of electrolytic corrosion to the metal components of the cell.

Chlorine and caustic, products of the electrolytic process, are basic chemicals which have become large volume commodities in the industrialized world today. The overwhelming amounts of these chemicals are produced electrolytically from aqueous solutions of alkali metal chlorides. Cells which have traditionally produced these chemicals have come to be known as chloralkali cells. The chloralkali cells today are generally of two principal types, the deposited asbestos diaphragm-type electrolytic cell or the flowing mercury cathode-type. Comparatively recent technological advances such as the development of the dimensionally stable anodes and various coating compositions, have permitted the gap between electrodes to be substantially decreased. This has dramatically increased energy efficiency during the operation of these energy-intensive units.

The development of a hydraulically impermeable membrane has promoted the advent of filter press membrane chloralkali cells which produce a relatively uncontaminated caustic product. This higher purity product obviates the need for caustic purification and concentration processing. The use of a hydraulically impermeable planar membrane has been most common in bipolar filter press membrane electrolytic cells. However, advances continue to be made in the development of monopolar filter press membrane cells.

Replenishing the depleted fluids within the anodes and cathodes has been accomplished in prior art structures simply by having external feed lines carry replenished fluids into the electrodes. These feed lines normally replenish the depleted fluids with fresh fluids by having the external feed lines feed into the top of the appropriate electrode or, in the case of the diaphragm-type cell, into the top of the electrolyte holding vessel.

Prior art structures have also replenished depleted fluids by using internal feed lines. These feed lines replenish the fluids, either deionized water in the case of the cathode or salt brine in the case of the anode, by either utilizing the existing electrode frame side channels to carry the fresh electrolyte towards the bottom of the electrode or feeding the electrolyte into the electrode from the top through short feed lines. An alternative approach is to direct replenished brine into a funnel-type structure connected to a pipe, and then allow the replenished brine to flow to the bottom of the electrolyte holding vessel where the concentrated replenished brine is allowed to mix with existing electrolyte.

These prior art methods fail to provide thorough mixing of the fresh electrolyte with the existing electrolyte before the fresh electrolyte contacts the cell membrane. These methods also fail to provide staged, gradual concentration changes in the electrolyte as it passes through the area or zone of the cell where electrolysis occurs. Lastly, none of the methods provide adequate resistance to the leakage of electrical current to ground.

In filter press membrane chloralkali cells this failure to thoroughly mix the electrolyte fluid prior to its entering the individual electrode is even more critical. The nature of the membranes is such that the membranes expand or swell as they absorb the deionized water which is fed into the cathodes from catholyte feed line. The membranes can also shrink if there is a high concentration of electrolyte, such as salt brine, which tends to dehydrate the membrane. In instances where there is not a thorough mixing of the fresh electrolyte with the depleted electrolyte, the concentration level of electrolyte will vary at different locations throughout the cell. The more concentrated electrolyte tends to dehydrate the membrane in those areas where it is in contact with the membrane. This dehydration tends to shrink the membrane at this point. Such differential swelling and shrinking of the filter press membrane presents operational problems which decrease the operating efficiency of the entire cell.

There is another problem peculiar to filter press membrane chloralkali cells which is created by the addition of fresh brine or other electrolyte chemicals directly into the electrode. The specific problem arises in the anodes of cells employing such a system where the direct addition of these chemicals into the anodes can cause the chemicals to locally attack the membrane. The reaction of the chemicals with the membrane reduces the operating life span of the membrane and generally adversely affects the efficiency of the system.

None of the prior art methods of recirculating and replenishing the cell fluids optimize cell efficiency. Frequently, the methods employed cause excessive dilution of the caustic in the cathodes upon the addition of deionized water. Dilution of the caustic normally occurs where the deionized water is added to the system prior to the withdrawal of the caustic product.

A continuing problem with filter press membrane electrolytic chloralkali cells has been the loss of electrical current due to leakage of electricity to ground. This obviously reduces the overall efficiency of the individual cell.

Additionally, excessive corrosion of the metal feed nozzles within the cell, as well as the metal electrode frames, also decreases the energy effectiveness of each unit. More significantly, however, corrosion of the metal parts within the cell may cause fluid leakage, structural damage or plugging of the electrolyte along its path of flow. This corrosion is accelerated by the high electric potential which typically is found in the affected components and can cause extensive outages or repairs.

Attempts to reduce the amount of electrical current leakage to ground led to the use of orifices and other devices in the brine feed line to break the electrically conductive stream of salt brine into droplets as it is sprayed into the gas space at the top of the cell. These droplets prevent current from traveling up through the electrolyte and out of the cell via the brine feed apparatus. This dropletting of brine has been called the "breaker effect". Such devices have been found effective for smaller electrolyte flows. However, in the large scale commercial production equipment employed today, these devices and others proposed for this purpose are unsatisfactory, frequently proving troublesome and hindering the efficient operation of the cell. Exemplary of the problems encountered in creating this breaker effect is the tendency of orifices and other such devices to become ineffective due to flooding and the increased maintenance that is required because of the larger sized equipment employed. Also, the requirement for large volume capacity equipment in the large sized commercial facilities utilized today has caused the efficient operating potential of such devices to be exceeded.

Other methods also have been employed in electrolytic cells in the caustic effluent streams to control electrical current leakage. Caustic effluent streams for example, have been broken or interrupted to achieve the breaker effect by free falling through air space into a funnel. In larger model cells the caustic stream can be divided by having the caustic flow over a fluted hanging cup weir before free falling into a funnel. Sizing the inlet and outlet channels to provide the desired level of resistance in the flow streams and controlling the voltage drop within the cell by segregating sections of the cell circuit into separate multiple units having voltage drops of approximately 40 volts or less has also been utilized to limit electrical leakage in bipolar chlorate cells. Non-conductive piping and sacrificial electrodes have also been employed in the industry to cope with the problem.

These methods of controlling current leakage present serious disadvantages in large scale filter press membrane cells for a variety of reasons. The size of the chambers required to break the flow stream tends to be large and, hence, expensive. Also, where metallic cell structure is in contact with the electrolyte fluids, as is the case in filter press membrane cells, the sizing of the inlet and outlet channels does not protect against electrolytic corrosion.

The foregoing problems are solved in the design of the apparatus comprising the present invention.

SUMMARY OF THE INVENTION

It is a principal object of the present invention to provide in a filter press membrane chloralkali electrolytic cell an improved external recirculation system which introduces feed fluid into a large diameter turbulent electrolytic recycle stream so that the feed fluid and recycled electrolyte are thoroughly mixed; to minimize the amount of electricity conducted in the feed fluid; and to ensure the recycled electrolyte is in low resistance contact with the electrode by maintaining the potential difference between the feed fluid in the feed line and the recycled electrolyte within the electrolyte return conduit from the point of exit from the feed line to the nearest electrically conductive component in the cell at a level below that at which electrolytic corrosion occurs.

It is another object of the present invention to prevent electrolytic corrosion and reduce the amount of electrical current lost to ground in a filter press membrane cell by providing an improved external recirculation system which removes in a long and thin stream electrolytic fluid, such as depleted brine from the anolyte portion of the recirculation system and product caustic from the catholyte portion of the recirculation system, from a large diameter electrolyte recycle stream so that the potential difference between the nearest electrically conductive component in the cell and the electrolyte in the large diameter electrolyte recycle stream is maintained at a level below that at which electrolytic corrosion occurs.

It is another object of the present invention to provide high electric resistance paths for feed streams entering and effluent streams exiting the cell to provide a relatively low electric resistance path within the recirculating electrolyte that reduces the possibility of electrolytic corrosion of metallic components within the cell.

It is a further object of the present invention to provide an improved recirculation system which adds concentrated salt brine into and withdraws depleted brine from the recirculation system in a manner to permit a slight concentration gradient in the electrolyte therein to thereby increase voltage and current efficiency.

It is still another object of the present invention that there is provided an improved recirculation system within the electrolytic cell that achieves a greater uniformity of concentration of electrolyte fluid that flows to each electrode.

It is a further object of the present invention to provide an improved recirculation system which decreases the amount of electrical current lost to ground during operation and, hence, to reduce damage due to electrolytic corrosion.

It is a feature of the present invention that the improved recirculation system utilizes a single electrolyte return conduit from the appropriate gas-liquid disengager with a single feed line within each return conduit to inject fresh feed brine and deionized water into turbulent recycle streams prior to the fresh feed fluids contacting the membranes separating the anodes and cathodes and which define the boundaries of their respective electrolytic compartments.

It is another feature of the present invention that a substantial portion of each small feed line and of each outlet pipe is enclosed within the larger return conduit within the recirculation system which employs external recirculation between the appropriate gas-liquid disengager and the corresponding individual electrodes.

It is a further feature of the present invention that the electrolytes circulating between the individual electrode compartments and the common gas-liquid disengagers are at essentially the same electric potential throughout so that there is no appreciable electrical current loss therethrough due to leakage between adjacent electrodes and adjacent cells.

It is yet another feature of the present invention that the flow of the feed brine is discharged within and the effluent brine is withdrawn from the much larger electrolyte return conduit so that the electrical potential drop is reduced to a small amount because of the large cross-section and the low electric resistance of the electrolyte in the recirculation line.

It is still a further feature of the present invention that a single feed line and a single electrolyte effluent outlet pipe are used in a single electrolyte return conduit which is manifolded to a plurality of electrode frames to recycle the electrolyte from the gas-liquid disengager to the individual electrode frames.

It is an advantage of the present invention that the improved external recirculation system prevents the mixing of feed brine and feed water with effluent and provides increased resistance to the leakage of electrical current to ground.

It is a further advantage of the improved recirculation system that the individual feed line which is inserted into the appropriate electrolyte return conduit promotes more uniform mixing of the fresh feed fluid and the recycle electrolyte so that there is greater uniformity in the concentration of fluids within all the electrodes.

It is another advantage that a substantial portion of the individual feed lines and the electrolyte effluent outlet pipes are within the corresponding electrolyte return conduit so that it is of generally compact design and not subject to damage from accidental contacts.

It is a further advantage of the present invention that the external recirculation system employs a single electrolyte return conduit for each anolyte and catholyte gas-liquid disengager with a single feed line and electrolyte effluent outlet pipe for each return conduit which reduces the possibility of electrolytic corrosion of any metal parts employed as well as reducing the amount of electrical leakage to ground that can occur because of the high electric resistance of the electrolyte in the single feed line and in the single outlet pipe.

These and other objects, features and advantages are obtained in a filter press membrane chloralkali electrolytic cell by providing an improved external electrolyte recirculation system wherein the feed stream lines and effluent outlet pipes are within the appropriate single electrolyte return conduit from the corresponding external gas-liquid disengager to thereby introduce feed fluids into and remove electrolyte effluents from a reservoir of electrolyte fluid which is in low electric resistance contact with the electrodes so that the potential difference between the recycled electrolyte within the single electrolyte return conduit and the nearest electrically conductive component within the cell is maintained at a sufficiently low level such that metal components of the cell are not electrolytically corroded. Further, the possibility of the leakage of electrical current to ground is reduced by the relative extended length and small diameter of the feed lines and effluent outlet pipes that result in a flow of feed electrolytes and electrolyte effluents along flow paths of small cross-sectional area.

BRIEF DESCRIPTION OF THE DRAWINGS

The advantages of this invention will become apparent upon consideration of the following detailed disclosure of the invention, especially when it is taken in conjunction with the accompanying drawings wherein.

DETAILED DESCRIPTION OF THE PREFERRED EMBODIMENT

It is to be understood that the filter press membrane cell described in the instant disclosure includes a plurality of electrodes. The electrodes are anodes and cathodes arranged in alternating sequence as will be described in greater detail hereafter. The term "anode" or "cathode" is intended to describe the entire electrode unit which is comprised of a frame which encases the periphery of the appropriate electrode and on opposing sides has anodic or cathodic surfaces, as appropriate, attached thereto. The space within the individual electrode between the electrode surfaces comprises the major portion of the compartment through which the anolyte or catholyte fluid, as appropriate, passes during the electrolytic process. The particular electrode compartment is defined by the pair of membranes that are placed adjacent, but exteriorly of the opposing electrode surfaces, thereby including the opposing electrode surfaces within each compartment. The term "anode" or "cathode" is further intended to emcompass the electrical current conductor rods that pass the current through the appropriate electrode, as well as any other elements that comprise the entire electrode unit.

Figure 1:
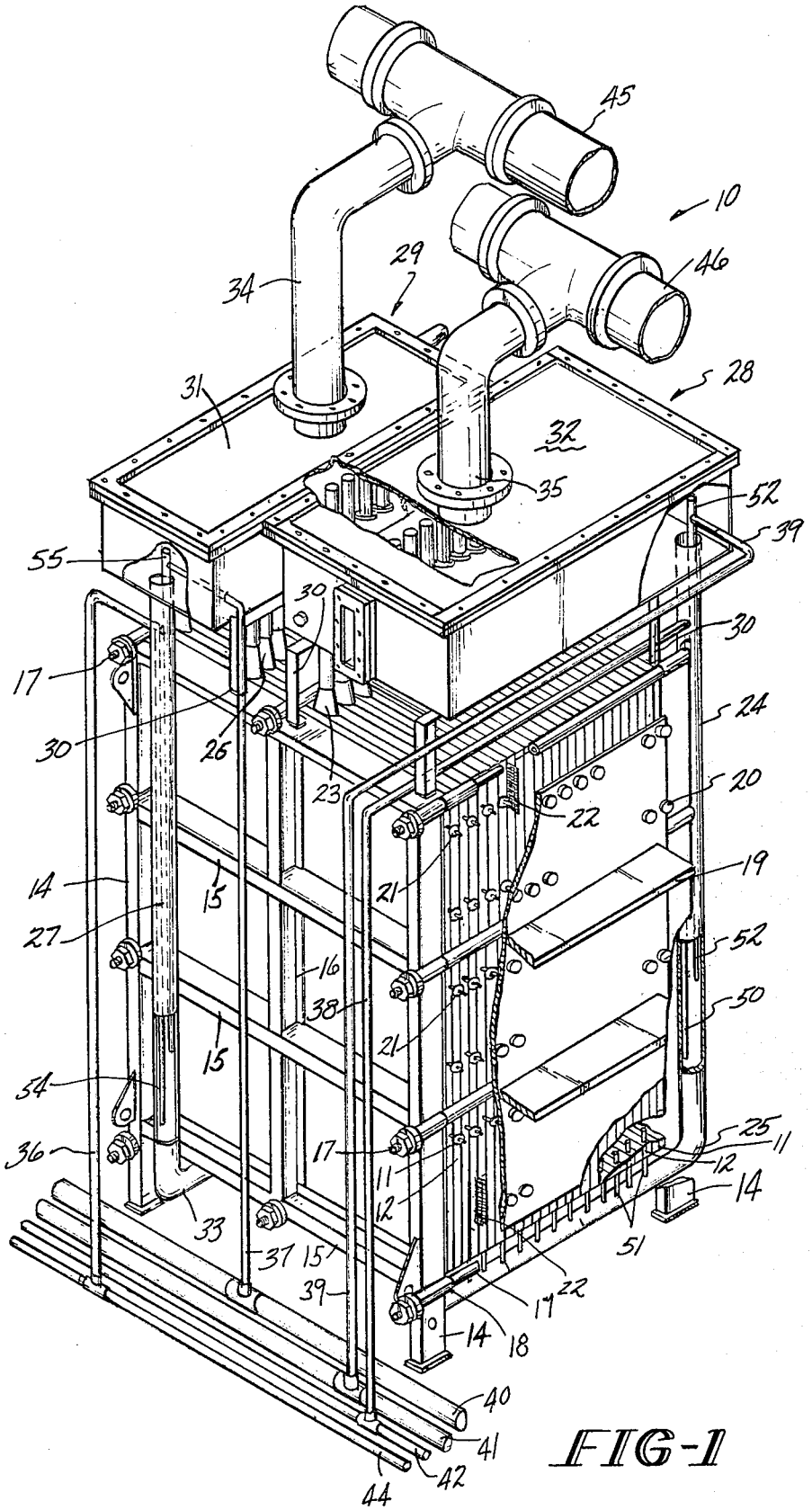
FIG. 1 is a side perspective view of a monopolar filter press membrane chloralkali electrolytic cell with appropriate portions broken away to illustrate the anodes, cathodes, the anolyte and catholyte gas-liquid disengagers, and the electrolyte external recirculation system.

Referring to FIG. 1, a filter press membrane cell, indicated generally by the numeral 10, is shown in a side perspective view. It can be seen that cathodes 11 and anodes 12 alternate and are oriented generally vertically. The cathodes 11 and anodes 12 are supported by vertical side frame members 14, horizontal side frame members 15, and intermediate vertical side frame members 16 (only one of which is shown). The cathodes 11 and anodes 12 are pressed together and secured by a series of tie bolts 17 which are inserted through appropriate mounting means affixed to the vertical side frame members 14 and horizontal side frame members 15. To prevent short circuiting between the electrodes during the electrolytic process, the tie bolts 17 have tie bolt insulators 18 through which the tie bolts 17 are passed in the area of the cathodes 11 and anodes 12.

Electrical current is passed, for example, from an external power source through the anode bus and then via anode bus nuts into the anode conductor rods, all not shown. From that point, the anode conductor rods pass the current into the anode surfaces, also not shown. The current continues flowing through the membrane 22, through the opposing cathode surfaces (not shown), the cathode conductor rods 21 and cathode bus nuts 20 to the cathode bus 19 where it continues its path out of the cell. The anodic conducting means are present on the opposite side of the filter press membrane cell 10 from the cathodic conducting means. Ion-selective permeable membranes 22 are diagramatically shown in FIG. 1 to illustrate how each anode 12 and cathode 11 are separated by the membranes.

Figure 2:
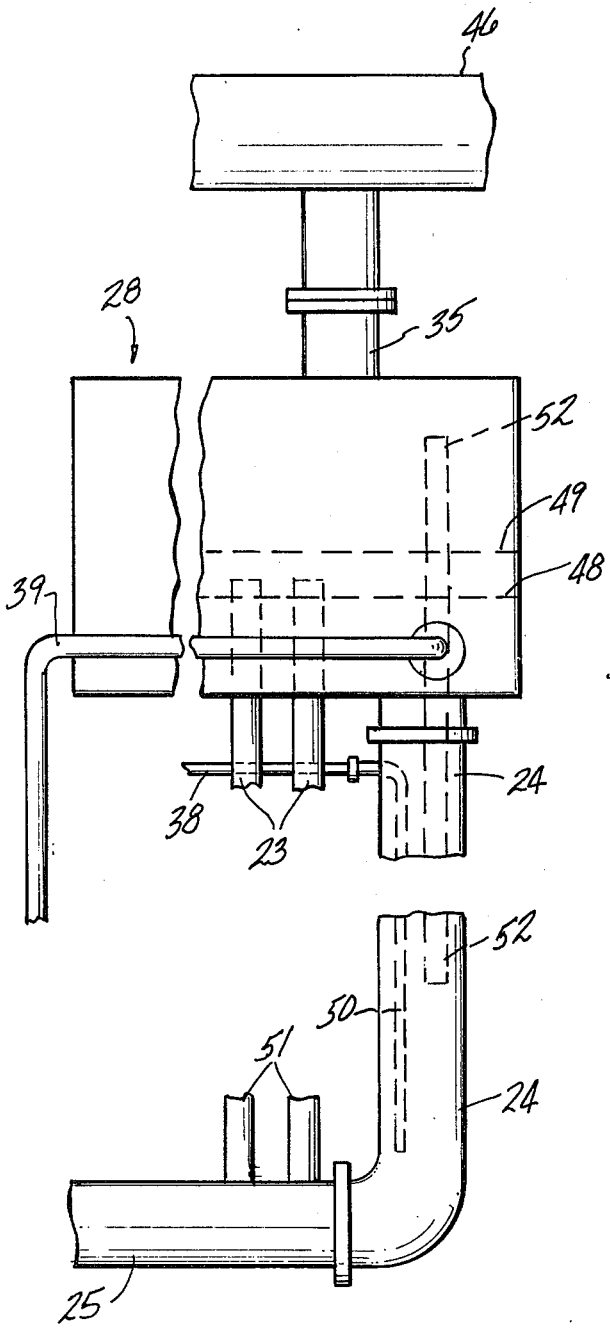
FIG. 2 is a side elevational view of the anolyte disengager showing the external recirculation system having the single anolyte return conduit, the single high electric resistance brine feed line feeding thereinto, the anolyte outlet pipe and the individual anode feed pipes that lead into each anode.

Projecting from the top of anode 12 and cathode 11 are a series of anode and cathode risers used for fluid flow between the appropriate gas-liquid disengager and the corresponding electrode. FIGS. 1 and 2 show anode risers 23, which project from the top of each anode 12. Similarly, cathode risers 26 are shown projecting from the top of each cathode 11 in FIG. 1. The risers are generally utilized to carry the appropriate electrolyte fluid with the accompanying gas, either anolyte with chlorine gas or catholyte with hydrogen gas, to the appropriate disengager mounted atop the filter press membrane cell 10. FIG. 1 also shows the single anolyte return conduit 24 that runs from the bottom of the anolyte gas-liquid disengager, indicated generally by the numeral 28, down to an anolyte manifold 25 which runs beneath the filter press cell 10. Similarly, the single catholyte return conduit 27 runs from the bottom of the catholyte gas-liquid disengager, indicated generally by the numeral 29, down to a catholyte manifold 33 that also runs beneath the filter press cell 10.

Anolyte disengager 28 and the catholyte disengager 29 are supported atop of the cell 10 by disengager supports 30. It is in each of these disengagers that the gas is enabled to separate from the liquid of the anolyte or catholyte fluid, as appropriate, and is released from the appropriate disengager via either a cathode gas release pipe 34 or an anode gas release pipe 35 affixed to the appropriate catholyte disengager cover 31 or anolyte disengager cover 32.

Also illustrated in FIG. 1 is the catholyte feed line 36 which carries deionized water in the single catholyte return conduit 27. The deionized water is appropriately fed into the recirculating reservoir of existing catholyte fluid which is recirculated from the catholyte disengager 29 to each cathode 11 in cell 10 in a manner that will be described in further detail hereinafter.

A catholyte output pipe 37 is also illustrated and serves to control the level of liquid in the catholyte disengager 29 by removing caustic to its appropriate processing apparatus.

Figure 3:
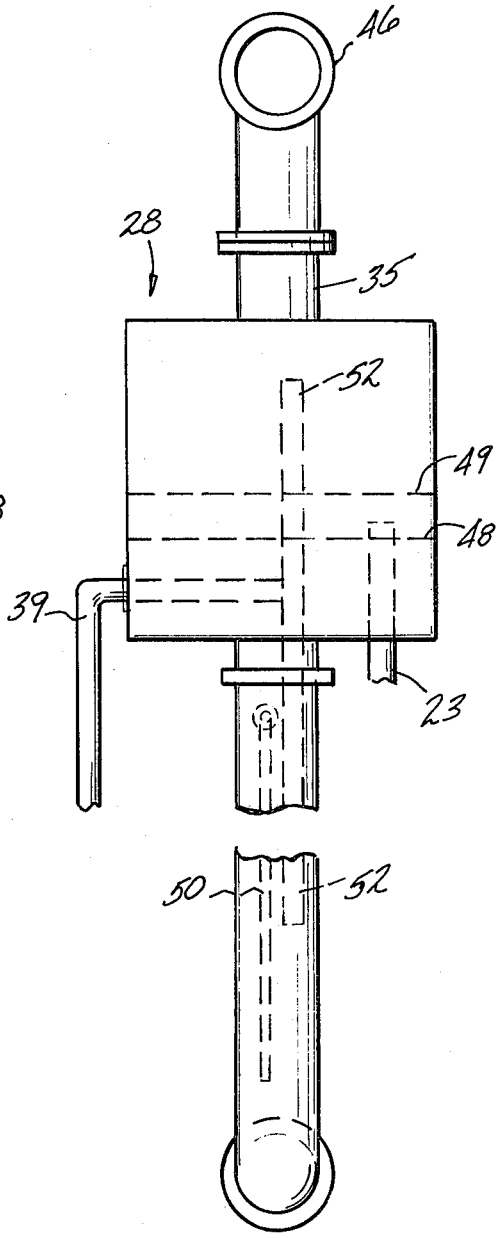
FIG. 3 is an end elevational view of the anolyte disengager and single anolyte return conduit, the single high electric resistance brine feed line feeding into the return conduit and the anolyte outlet pipe.

An anolyte feed line 38 carries fresh brine into the single anolyte return conduit 24 and is seen in FIGS. 1, 2, and 3. The fresh brine is then appropriately fed into the recirculating reservoir of existing anolyte fluid which is recirculated from the anolyte disengager 28 into each anode 12 in a manner that will be described in further detail hereinafter. An anolyte output pipe 39 is also shown and serves to control the level of liquid in the anolyte fluid within the anolyte disengager 28 by removing the spent brine for regeneration.

Also shown in FIG. 1 are the plurality of headers which run along the front of the bank of filter press cells. The bank of cells typically is formed by the side placement of individual filter press membrane cells 10. Caustic header 40 is connected to the catholyte disengager 29 via the catholyte outlet pipe 37. The spent brine or anolyte effluent header 41 is connected to the anolyte gas-liquid disengager 28 via anolyte outlet pipe 39. Fresh brine flows within the brine header 42 and via the anolyte feed line 38 into the recirculation system for the cell 10. The deionized water flows in the deionized water header 44 and passes via the catholyte feed line 36 to the recirculation system for the cathodes 11 and the catholyte gas-liquid disengager 29.

Also shown in FIG. 1 is the hydrogen gas header 45 which connects, via the cathode gas release pipe 34, to the catholyte gas-liquid disengager 29. Similarly, a chlorine gas header 46 connects, via the anode gas release pipe 35, to the anolyte gas-liquid disengager 28. The hydrogen gas header 45 and the chlorine gas header 46 overlie the bank of cells formed by the individual cells 10 and are connected to each adjacent cell 10 in the manner just described or in any other suitable fashion.

The filter press membrane cell 10 has been described only generally since the structure and the function of its central components are well known to one of skill in the art.

Referring now to FIGS. 2 and 3, a typical arrangement of the anolyte gas-liquid disengager 28, the single anolyte return conduit 24 and the other associated pipes are seen in relation to each other. The anolyte gas-liquid disengager 28 is shown with the anode risers 23 extending upwardly from the top of the individual anodes 12 of FIG. 1 into the anolyte gas-liquid disengager 28. The anode risers 23 extend upwardly to a point just above the liquid level 48 in the disengager 28 under normal operating conditions. A foam level 49 lies above the liquid level as seen. Exiting from the bottom of the anolyte gas-liquid disengager 28 is the single anolyte return conduit 24. The anolyte feed line 38 is seen entering the single anolyte return conduit 24 just below the anolyte gas-liquid disengager 28.

The anolyte feed line 38 extends a predetermined distance down into the anolyte return conduit 24 via an internal portion 50 to a point just above where the return conduit 24 meets the anolyte manifold 25. The internal portion 50 of the anolyte feed line 38 is of the same diameter as the portion of the anolyte feed line 38 that is external to the anolyte return conduit 24 and is of sufficiently small cross-section to minimize electrical conductivity of the electrolyte flowing within it. The long length of the internal portion 50 of anolyte feed line 38 within the anolyte return conduit 24 permits the feed line to discharge brine within a large diameter stream of low electric resistance anolyte fluid. This permits the release of a stream of concentrated feed brine into the recirculating electrolyte at a point within the recirculation system that effects the thorough mixing of the replenished brine and electrolyte prior to the mixed solution's entering the individual anodes 12. The feed brine and the recycled electrolyte thus are thoroughly mixed prior to having any contact with the membranes 22, which separate each anode 12 and cathode 11. This thorough mixing thereby avoids any differential swelling and shrinking of the membranes due to varying brine concentration levels within each anode. The particularly long path of feed brine within the anolyte feed line 38 provides high electric resistance to the leakage of electrical current through the feed brine carried therein from the cell.

A similar feed arrangement of the deionized water into the single catholyte return conduit 27 from the catholyte feed line 36 employs the same principle with the same effect.

As can be seen in FIG. 1, the catholyte feed line 36 enters the catholyte return conduit 27 below the catholyte disengager 29. The internal portion 54 of catholyte feed line 36 extends down into the catholyte return conduit 27 a predetermined distance to a point just above where the return conduit 27 meets the catholyte manifold 33. Similarly to the anolyte portion of the recirculation system, the internal portion 54 is of the same diameter as the portion of the catholyte feed line 36 external to the electrodes and disengager 29 and again is of sufficiently small cross-section so that the electrical conductivity of the electrolyte flowing within it is minimized. The exiting of the feed deionized water into the large diameter stream of low resistance catholyte fluid at this point permits thorough mixing of the feed deionized water and the catholyte fluid prior to the mixed solution's entering the individual cathodes.

Utilizing elongated and non-conductive feed lines with small cross-section sizes between the appropriate headers and the return conduits minimizes the electrical conductivity of the flowing electrolyte and reduces the leakage of electrical current to ground.

The appropriate electrolyte, thoroughly mixed with the feed from the appropriate feed line, passes from the return conduit into the appropriate manifold, and then into the appropriate electrode via feed pipes. As best seen in FIG. 2, the anolyte manifold 25 connects via anode feed pipes 51 to the individual anodes 12 of FIG. 1. These feed pipes 51 permit the anolyte fluid to enter the bottom of the individual anodes 12 through the anode frames so that a full recirculation loop is effected. Similarly, although not specifically shown, it is to be understood that the catholyte manifold 33 is connected by feed pipes to the individual cathodes 11, thereby permitting the recycled catholyte fluid to enter the bottom of the individual cathodes 11 through the cathode frames. This closes the catholyte fluid recirculation loop of fluid flowing from the catholyte disengager 29 through the catholyte return conduit 27 to the catholyte manifold 33.

The recirculation loops within the external recirculation system provide in each instance for a low electric resistance path through the electrolyte to the appropriate electrode from the point of juncture of the feed line with the return conduit, expecially in the instance of the anolyte feed line 38 and the single anolyte return conduit 24. This low electric resistance path to each electrode tends to conduct a small amount of current flowing through the feed pipe directly to the electrode so that the potential difference between the electrolyte solution entering the electrode compartment and the metal parts at the inlet point to the cell is below the electromotive force level at which electrolytic corrosion of the metal will occur.

Also shown in FIG. 2 is the anolyte outlet pipe 39. Anolyte outlet pipe 39 is shown extending substantially the full length of the anolyte gas-liquid disengager 28 to a point on the side where it enters the disengager. FIG. 3 shows best how the outlet pipe 39 connects to a vent pipe 52 within the disengager 28. Vent pipe 52 extends downwardly into the single anolyte return conduit 24 a predetermined distance, but not below the bottom of the internal portion 50 of anolyte feed 38. Vent pipe 52 extends upwardly above the foam layer surface 49 a sufficient distance so that any gases that may be drawn out with the electrolyte liquid may be vented within the disengager 28. The vent pipe 52, by extending above the foam layer, provides a siphon break that prevents the siphoning or draining of excessive amounts of anolyte fluid from the system and, in effect, establishes the liquid level in the disengager 28.

FIG. 1 shows the catholyte outlet pipe 37 exiting the side of the catholyte disengager 29. Inside the catholyte disengager 29 the outlet pipe 37 connects with a catholyte vent pipe 55, which is similar in its placement and structure to the anolyte vent pipe 52 previously described. As illustrated in FIG. 1, vent pipe 55 extends downwardly into the catholyte return conduit 27 a predetermined distance, but not below the bottom of the internal portion 54 of catholyte feed line 36. Vent pipe 55 also extends upwardly through the liquid layer (not shown) and what would be the foam surface layer (also not shown) under normal operating conditions to provide a siphon break that prevents the siphoning or draining of excessive amounts of catholyte fluid from the catholyte disengager via the catholyte outlet pipe 37. The vent pipe 55 also permits any gases that might be drawn into the outlet pipe 37 to be vented into the catholyte disengager 29 prior to being carried to the caustic header 40.

This type of recirculation system is equally applicable to a cathode disengager 29 as well as an anolyte disengager 28. A vent pipe provides both a simple and effective current leakage control without the need for external traps or spray chambers while preventing caustic soda from contacting ambient air to thereby avoid carbon dioxide contamination. Naturally, in the instance of the anolyte recirculation loop, since the anolyte fluid is contained within a closed recirculation system and there is no contact with air, the release of any chlorine gas is also avoided.

Thus it can be seen that the length of the pipes between the headers 41 and 42 and the points of connection within the cell are relatively longer than a direct connection. This, therefore, provides a higher electric resistance flow path that is external of the cell. It can also be seen that a substantial part of the length of the anolyte feed line 38 and catholyte feed line 36 are enclosed within the external portion of the recirculation system of the cell. Electrical conductivity is decreased by using non-conductive material for these pipes. The anolyte feed pipe 38 may typically be constructed of polyvinylidene chloride (PVDC), chlorinated polyvinyl chloride (CPVC), polyfluorotetraethylene (Teflon®), or other corrosion resistant non-conductive materials. The catholyte feed line 36 may be made of CPVC or other appropriate material.

The length and diameter of all of the pipes in the recirculation system are determined by a combination of factors such as the pressure drop available, the specific conductivity of the particular solution utilized, the voltage of the circuit, and specific flow throughout the system. The diametric dimensions of the anolyte return conduit 24, the catholyte return conduit 27, the anolyte outlet pipe 39, the catholyte outlet pipe 37, the catholyte feed line 36 and the anolyte feed line 38 are determined by the friction head loss so as to provide a uniform head loss or pressure drop of only a few inches of water. The diameters of the anode feed pipes 51 and the cathode feed pipes (not shown) are determined by the friction head loss so as to provide a uniform head loss of a few pounds per square inch since such relatively high head loss improves distribution of the replenishing liquid in the cell 10. Typically, the anolyte return conduit 24 and the catholyte return conduit 27 utilize 8 inch diameters, while the anolyte outlet pipe 39 and the catholyte outlet pipe 37 have been 2 inches in diameter. The anolyte disengager 28 was designed to be approximately 3 feet high while the catholyte disengager 29 was designed to be approximately $1\frac{1}{2}$ feet high. The catholyte feed line 36 and the anolyte feed line 38 were designed to be $\frac{1}{2}$ inch diameter. The anode feed pipes 51 and the cathode feed pipes (not shown) are 2 inches in diameter and typically extend 8 inches in length.

The uniform head loss of a few pounds per square inch in the anode feed pipes 51 and the cathode feed pipes (not shown) also serves to minimize electrical current leakage within the cell. This also improves the mixing of recycled brine or caustic with the fresh brine or deionized water, as appropriate, by creating a high velocity in the liquid flowing within the electrolyte recirculation loops within the cell's recirculation system at the point of exit from the appropriate feed lines into the appropriate anolyte return conduit 24 or catholyte return conduit 27.

The recirculation or return conduit for the electrolytes within the cell, into which are injected the feed streams of brine or deionized water and from which are taken anolyte and catholyte effluents, may be either metallic or non-metallic. Of significance is the ratio of resistances of the electrolyte fluids within the feed lines and the electrolyte fluids within return conduits from the point of exit from the feed lines to the nearest electrically conductive component in the cell 10. Typically for protection of titanium utilized in the fabrication of the anode frames, it is desirable for practical purposes to have the potential difference between the electrolyte and the metal less than ±3 volts. For protection of nickel or steel utilized in the fabrication of the cathode frames, it is desirable for practical purposes to have the potential difference between the electrolyte and the metal less than ±0.5 volts. For a typical voltage to ground of 200 volts, a ratio between the electric resistance of the electrolyte fluid within the appropriate feed line and that of the electrolyte fluid in the corresponding return conduit from the point of exit from the feed lines to the nearest electrically conductive component in the cell 10 should be approximately 400:1, and for 100 volts to ground, the ratio would be typically 200:1.

The ratio of feed to recycled liquids may range from about 1:10,000 or from about 1:0.5 depending upon the feed additive and the specific purpose. In particular, for feed brine it is desired to have a ratio of feed to recycled liquid ranging from about 1:5 to about 1:100. The preferable range is from about 1:10 to about 1:50. These ratios to feed to recycled brine or deionized water are obtained by having cross-sectional areas within the anolyte feed line 38 and catholyte feed line 36 and cross-sectional areas within the anolyte and catholyte return conduits 24 and 27, respectively, which range from about 1:4 to 1:1000. Although not shown, control valves are placed on the anolyte feed line 38 and the catholyte feed line 36 to control the flow rate that goes into each return conduit. To measure the flow rate, rotometers (not shown) are also placed on the anolyte feed line 38 and the catholyte feed line 36 between the control valves and the appropriate return conduit to measure the flow of feed, usually in gallons per minute.

Because the feed brine, especially, is injected into the anolyte return conduit 24 via the anolyte feed line 38 in a small stream over a path extending many feet in length, there is sufficient electrical resistance to limit the loss of electrical energy from the cell 10 via leakage to ground. Also, since feed brine is added to the anolyte portion of the recirculation system after the withdrawal of anolyte from the anolyte portion of the recirculation system through the anolyte outlet pipe 39, the anolyte vent pipe 52, a more concentrated brine is introduced into each anode 12. This concentrated brine tends to increase voltage efficiency and current efficiency or to reduce the amount of brine feed required, or a combination of both. In the catholyte portion of the recirculation system, the deionized feed water is added via the catholyte feed line 36 to the catholyte return conduit 27 after the withdrawal of the caustic product via the catholyte outlet pipe 37 and the catholyte vent pipe 55. This produces a more concentrated caustic than if the deionized water is introduced prior to the withdrawal of the caustic product or conversely, permits electrolyte of a slightly lower concentration than the concentration of the caustic product to be introduced into each cathode.

The addition of feed to the circulating electrolyte is made after withdrawal of the effluents from the recirculation system. In the anolyte portion of the recirculation system this permits a gradient of brine concentration to be established between the point of feed and the discharge. The brine feed concentration is higher directly subsequent to the feed addition from the anolyte feed lines 38 into the anolyte return conduit 24. This concentration then decreases slightly, but significantly to a lower concentration at the point of discharge from the anode feed pipes 51 into each anode 12. The concentration decreases further as the electrolyte rises from the bottom of each anode 12 up through the anodes and into the anolyte disengager 28 through the risers 23. The most dilute electrolyte or brine is found in the anolyte outlet pipe 39 where the brine is carried away from the anolyte disengager 28.

In the catholyte portion of the recirculation system, the caustic concentration is lowest, and, therefore, the optimum for highest current efficiency, directly subsequent to the deionized water feed addition from the catholyte feed line 36 into the catholyte return conduit 27. The caustic concentration increases slightly, but significantly at the point of discharge from the cathode feed pipes (not shown) into each cathode 11. The caustic increases in concentration as it rises upwardly within the cathodes 11 and passes through the risers 26 into the catholyte disengager 29. The most concentrated caustic is carried from the recirculation system via the catholyte outlet pipe 37.

Finally, since each individual cathode 11 and anode 12 receives feed in the recirculation system via their individual anode feed pipes 51 and cathode feed pipes (not shown), uniformity of concentration among the cathodes 11 and anodes 12 is obtained.

By way of example to illustrate the principles of the invention disclosed herein and without any intention of limiting the scope of the invention to the specifics of what is discussed hereafter, the following example is presented.

EXAMPLE

A filter press membrane chloralkali cell of approximate 10 foot height, 5 foot width and 5 foot depth was designed with alternating cathodes and anodes. The electrodes were approximately 7 feet high, approximately 5 feet wide and approximately 2 inches thick. The cathodes were designed to be made from nickel with activated nickel cathodic surfaces. The anodes were designed to be made from titanium with anodic surfaces that were catalytically coated.

The cathodes were designed to be connected to an external gas-liquid disengager via catholyte risers and a single catholyte return conduit connected to a catholyte manifold that fed into the bottom of each cathode. The catholyte return conduit was designed to be approximately 9 feet in length, approximately 8 inches in diameter and made from CPVC. A catholyte feed line carries deionized water from a deionized water header and was approximately 15 feet in length, approximately ½ inch in diameter and made from CPVC. A catholyte outlet pipe ran from the catholyte return conduit to a caustic header and was approximately 15 feet in length, 2 inches in diameter and made from CPVC.

The anodes were designed to be connected to an external gas-liquid disengager via anolyte risers and a single anolyte return conduit that connected to an anolyte manifold. The manifold ran beneath the cell and connected into the bottom of the individual anodes. The anolyte return conduit was designed to be approximately 9 feet in length, approximately 8 inches in diameter and made from CPVC. An anolyte feed line carries salt brine from a brine header to the anolyte return conduit and was approximately ½ inch in diameter, approximately 20 feet in length and made from CPVC. An anolyte outlet pipe ran from the anolyte return conduit to an anolyte effluent header and was approximately 20 feet in length, 2 inches in diameter and made from CPVC.

A flow of 6 gpm of purified NaCl brine of 315 gpl NaCl concentration was fed into the filter press membrane cell that was operating at 150 KA. Based on a resistivity of feed brine of 1.8 ohm-centimeters and a resistivity of circulating anolyte of 2.2 ohm-centimeters at an operating temperature of 80° C., the resistance of the feed brine in the 20 foot long anolyte feed line can be calculated as approximately 338 ohms. A typical resistance of the recycled electrolyte over a 1 foot distance within the 8 inch diameter anolyte return conduit can be calculated to be approximately 0.2 ohms. Based on a voltage from ground of approximately 200 volts, current leakage can be calculated according to Ohm's Law as approximately 0.6 amperes.

With a current leakage of 0.6 amperes the maximum potential difference between the electrolyte in the anolyte return conduit and the nearest titanium components of the frame can be calculated according to Ohm's Law as approximately 0.12 volts. This potential difference, thus, is considerably less than the 3.0 volt value commonly accepted as the level at which appreciable electrolytic corrosion will occur in titanium.

In operation, a filter press membrane cell 10 has an electric current from an external power source conducted via an anode bus, anode bus bolts and anode conductor rods into the surfaces of each anode 12. The electrical current passes through the membrane 22 and is conducted via the surfaces of each cathode 11 to the cathode conductor rods 21, the cathode bus bolts and then the cathode bus 19 from where it continues its path of flow. Electrolyte fluid, principally a salt brine, is fed from the brine header 42 via the anolyte feed line 38 into the anolyte return conduit 24, the anolyte manifold 25 and then into each anode 12 via the anode feed pipes 51. The anolyte fluid passes from each anode 12 into the anolyte disengager 28 via the anode risers 23. The anolyte recirculation loop is completed by having the anolyte fluid exit the anolyte disengager 28 into the anolyte return conduit 24.

A fluid for feeding the catholyte fluids, such as deionized water, is fed through the deionized water header 44 to the catholyte feed line 36 into the catholyte return conduit 27, the catholyte manifold 33 and then via cathode feed pipes (not shown) into each cathode 11. The catholyte fluid with the now mixed deionized water rises up through the individual cathodes 11 into the catholyte disengager 28 through the cathode risers 26. The catholyte loop portion of the recirculation system is completed by having the catholyte fluid exit the catholyte disengager 29 into the catholyte return conduit 27.

The electrolytic process within the cell causes the freeing of chlorine from the salt brine and hydrogen from the deionized water. The chlorine rises as a gas with the anolyte fluid through the anode risers 23 into the anolyte disengager 28. Within the disengager 28, the chlorine gas is permitted to separate from the anolyte fluid and leaves the disengager 28 via the anode gas release pipe 35 and the chlorine gas header 46 enroute to appropriate gas processing apparatus. In the cathodes 11, the hydrogen gas moves with the catholyte fluid, including the appropriate caustic, upwardly through the cathode risers 26 into the catholyte disengager 29. The hydrogen gas is separated from the catholyte fluid and leaves the catholyte disengager 29 via the cathode gas release pipe 34 and the hydrogen gas header 45 which connect to appropriate gas processing apparatus. The caustic is removed for appropriate processing via the catholyte outlet pipe 37. The brine and the deionized water are replenished within the recirculation system via the aforementioned catholyte feed line 36 and anolyte feed line 38, respectively. The injection of these feed fluids into their appropriate return conduits in long, thin streams promotes thorough mixing of the brine with the recycled anolyte fluid and deionized water with the recycled catholyte fluid prior to the entry of the anolyte fluid and the catholyte fluid into the anodes 12 and cathodes 11, respectively.

It should also be noted that the gas-liquid disengagers employed within the recirculation system could equally well be cylindrical in shape. This may be desireable from a cost reduction standpoint because such a design will permit the use of thinner walls in the disengagers.

While the preferred structure in which the principles of the present invention have been incorporated is shown and described above, it is to be understood that the invention is not to be limited to the particular details thus presented, but in fact, widely different means may be employed in the practice of the broader aspects of this invention. For example, although the primary use for the invention disclosed herein is for lines feeding brine and make-up water, the same method and equipment are suitable for other additives, such as acid, recycled caustic, phosphate solutions, sulfide solutions and the like. The scope of the appended claims is intended to encompass all obvious changes in the details, materials and arrangement of parts which will occur to one of skill in the art upon a reading of the disclosure.

Having thus described the invention, what is claimed is:

1. In a filter press membrane chloralkali electrolytic cell containing electrolyte fluid connectable to a source of electrical energy utilized to energize the electrolytic reaction therein, the combination comprising:

(a) frame means to support the cell;

(b) a plurality of planar cathodes supported by the frame means, each cathode further having two opposing surfaces, a top and a bottom;

(c) a plurality of planar anodes supported by the frame means, each anode being sandwiched between a pair of cathodes and having two opposing surfaces, a top and a bottom;

(d) a plurality of planar hydraulically impermeable ion-selective membranes positioned between each anode and cathodes to control the flow of ions and fluid thereacross;

(e) a catholyte disengager external to each cathode and in fluid flow communication therewith at least partially supported by the frame means for the separation of gas from the catholyte fluid contained therein;

(f) an anolyte disengager external to each anode and in fluid flow communication therewith at least partially supported by the frame means for the separation of gas from the electrolyte fluid contained therein;

(g) an anolyte return conduit of predetermined length external of the anodes in fluid flow communication with the anolyte disengager and the individual anodes, the anolyte return conduit having a first predetermined cross-sectional area through which electrolyte fluid flows to recirculate electrolyte from the anolyte disengager to the anodes;

(h) a catholyte return conduit of predetermined length external of the cathodes in fluid flow communication with the catholyte disengager, the catholyte return conduit having a second predetermined cross-sectional area through which catholyte fluid flows to recirculate fluids from the catholyte disengager to the cathodes;

(i) anolyte outlet means having a first portion joined at a junction with a second portion, the first portion extending from the anolyte disengager into the anolyte return conduit a first predetermined distance and the second portion exiting the anolyte disengager; and (j) feed means for replenishing electrolyte fluid connected to the anolyte return conduit and external to the anolyte disengager to provide a flow of fresh electrolyte to the cell, the means extending a second predetermined distance greater than the first predetermined distance into the anolyte return conduit and having a third predetermined cross-sectional area substantially less than the first predetermined cross-sectional area such that the outlet of the flow of fresh electrolyte is into the flow of recirculated electrolyte within the anolyte return conduit to effect thorough mixing of the fluids prior to entering each anode and to decrease the leakage of electrical energy therethrough.

2. The apparatus according to claim 1 wherein the anolyte return conduit is connected to an anolyte manifold that extends beneath the plurality of planar anodes.

3. The apparatus according to claim 2 wherein the anolyte manifold is connected to the bottom of each planar anode by an anode feed pipe carrying replenished electrolyte into each planar anode.

4. The apparatus according to claim 3 wherein the anolyte outlet means at the junction of the first portion and the second portion extends generally upwardly in the anolyte disengager to a level above the electrolyte fluid with an open-topped third portion that serves as a siphon break.

5. The apparatus according to claim 1 wherein the cell further includes feed means for replenishing the catholyte fluid connected to the catholyte return conduit and external to the catholyte disengager to supply a flow of catholyte fresh fluid to each planar cathode.

6. The apparatus according to claim 5 wherein the feed means for replenishing the catholyte fluid further extends a third predetermined distance into the catholyte return conduit and having a fourth predetermined cross-sectional area substantially less than the second predetermined cross-sectional area such that the outlet of the flow of fresh catholyte fluid is into the flow of recirculated fluids from the catholyte disengager to the planar cathodes within the catholyte return conduit to effect thorough mixing of the fluids prior to entering each cathode.

7. The apparatus according to claim 6 wherein the catholyte return conduit is connected to a catholyte manifold that extends beneath the plurality of planar cathodes.

8. The apparatus according to claim 7 wherein the catholyte manifold is connected to the bottom of each planar cathode by a cathode feed pipe carrying replenished catholyte fluid into each planar cathode.

9. The apparatus according to claim 8 further comprising a catholyte outlet means having a first portion joined at a junction with a second portion, the first portion extending from the catholyte return conduit a fourth predetermined distance less than the third predetermined distance and the second portion exiting the catholyte disengager.

10. The apparatus according to claim 9 wherein the catholyte outlet means at the junction of the first portion and the second portion extends generally upwardly in the catholyte disengager to a level above the catholyte fluid with an open-topped third portion that serves as a siphon break.

11. In a filter press membrane cell for the production of chlorine and hydrogen gas and a caustic having a plurality of anodes of predetermined height with a top and a bottom connected to an electrical power source, an external anolyte disengager in fluid flow communication with each anode via an anolyte return conduit having a first predetermined cross-sectional area utilized to recirculate electrolyte from the disengager to a location adjacent the bottom of each anode, electrolyte feed replenisher means connected to the anolyte return conduit and each anode, the improvement comprising:

an improved electrolyte recirculation system wherein the electrolyte feed replenisher means is connected to the anolyte return conduit external of the anolyte disengager, the anolyte return conduit being external of the anodes and in fluid flow communication with each anode via an anode feed pipe extending into the bottom of each anode, the electrolyte feed replenisher means further extending a first predetermined distance into the anolyte return conduit and having a second predetermined cross-sectional area such that the outlet flow of replenishing electrolyte is into the flow of recirculated electrolyte within the anolyte return conduit to effect thorough mixing of the fluids prior to entering the anode and to decrease the leakage of electrical current therethrough.

12. The apparatus according to claim 11 wherein the anolyte return conduit is connected to an anolyte manifold that extends beneath the plurality of anodes.

13. The apparatus according to claim 12 further comprising an anolyte outlet means having a first portion joined at a junction with a second portion, the first portion extending from the anolyte disengager into the anolyte return conduit a second predetermined distance less than the first predetermined distance and the second portion exiting the anolyte disengager.

14. The apparatus according to claim 13 wherein the anolyte outlet means at the junction of the first portion and the second portion extends generally upwardly in the anolyte disengager to a level above the electrolyte fluid with an open-topped third portion that serves as a siphon break.

15. In a filter press membrane cell for the production of chlorine and hydrogen gas and a caustic having a plurality of anodes of predetermined height with a top and a bottom connected to an electrical power source, an external anolyte disengager in fluid flow communication with each anode via an anolyte return conduit having a first predetermined cross-sectional area utilized to recirculate electrolyte from the disengager to a location adjacent the bottom of each anode, an improved electrolyte recirculation system comprising in combination:

(a) the anolyte return conduit being external of the anolyte disengager and the anodes connected to the electrolyte feed replenisher means;

(b) an anolyte manifold positioned beneath the bottom of the cell and in fluid flow communication with each anode via a plurality of anode feed pipes that extend up into the bottom of each anode a predetermined distance; and (c) electrolyte feed replenisher means connected to the anolyte return conduit extending a first predetermined distance into the anolyte return conduit and having a second predetermined cross-sectional area such that the outlet flow of replenishing electrolyte is into the flow of recirculated electrolyte within the anolyte return conduit to effect thorough mixing of the fluids in the anolyte return conduit and the anolyte manifold prior to entering each anode.

16. In a filter press membrane cell for the production of chlorine and hydrogen gas and a caustic having a plurality of cathodes of predetermined height with a top and a bottom connected to an electrical power source, an external catholyte disengager in fluid flow communication with each cathode via a catholyte return conduit having a first predetermined cross-sectional area utilized to recirculate electrolyte from the disengager to a location adjacent the bottom of each cathode, an improved electrolyte recirculation system comprising in combination:

(a) the catholyte return conduit being external of the catholyte disengager and the cathodes connected to the electrolyte feed replenisher means;

(b) a catholyte manifold positioned beneath the bottom of the cell and in fluid flow communication with each cathode via a plurality of cathode feed pipes that extend up into the bottom of each cathode a predetermined distance; and (c) electrolyte feed replenisher means connected to the the catholyte return conduit extending a first predetermined distance into the catholyte return conduit and having a second predetermined cross-sectional area such that the outlet flow of replenishing electrolyte is into the flow of recirculated electrolyte within the catholyte return conduit to effect thorough mixing of the fluids in the catholyte return conduit and the catholyte manifold prior to entering each cathode.

* * * * *